US005960509A

United States Patent [19]

Wu

[11] Patent Number: 5,960,509

[45] Date of Patent: Oct. 5, 1999

[54] MULTI-FUNCTIONAL BACK BRUSH

[76] Inventor: Chia-Hao Wu, P.O. Box 82-144, Taipei, Taiwan

[21] Appl. No.: 09/025,573

[22] Filed: Feb. 18, 1998

[51] Int. Cl.[6] ..... A47K 7/02; A61H 15/00

[52] U.S. Cl. ..... 15/244.2; 15/244.3; 15/144.1; 15/172; 15/176.6; 601/137; 403/91; 403/93

[58] Field of Search ..... 15/172, 176.6, 15/144.1, 244.2, 244.1, 244.3, 176.1, 201, 203, 229.11; 601/134, 135, 137, 138; 403/91, 92, 93, 97, 98, 99

[56] References Cited

U.S. PATENT DOCUMENTS

| | | | |
|---|---|---|---|
| 2,609,251 | 9/1952 | Haupt | 15/172 |
| 2,749,567 | 6/1956 | Krueger | 15/172 |
| 4,731,896 | 3/1988 | de La Tour | 15/172 |
| 5,572,763 | 11/1996 | Eguchi | 15/172 |
| 5,581,838 | 12/1996 | Rocco | 15/172 |

FOREIGN PATENT DOCUMENTS

| | | | |
|---|---|---|---|
| 534114 | 9/1931 | Germany | 15/172 |

*Primary Examiner*—Gary K. Graham
*Attorney, Agent, or Firm*—A & J

[57] ABSTRACT

A multi-functional back brush includes a brush head having an upper portion provided with a strap, a front end formed with a first opening, a rear end formed with a second opening, an adjustable shaft having a first end engageable with the first and second openings of the brush head, an axle fitted through the center through hole of the adjustable shaft and having an end provided with a disk formed with a plurality of teeth engaged with a circular toothed recess of the adjustable shaft, a handle having a circular end engaged with the second end of the adjustable shaft, a toothed rack mounted on a bottom of the handle, an adjusting block movably engaged with the toothed rack, a T-shaped member fixedly mounted on the circular end of the handle and having a resilient blade engaged with radial partitions of adjustable shaft, a spring fitted within the circular end of the handle, an actuator arranged within the circular end of the handle, a cap threadedly engaged with the circular end of the handle, and a pushbutton fitted within the cap, whereby the brush head can be conveniently adjusted in angular position as desired.

4 Claims, 9 Drawing Sheets

MULTI-FUNCTIONAL BACK BRUSH

BACKGROUND OF THE INVENTION

1. Field of the Invention

This invention is related to a multi-functional back brush and in particular to one of which the brush head can be conveniently adjusted in angular position as desired.

2. Description of the Prior Art

It has been found that various brush assemblies are provided in the prior art to enhance brushing and cleansing of an individual, such as utilized in a shower, bath and the like. The most commonly used back brush includes a base plate provided with a series of rows of brush bristles directed outwardly therefrom. However, it is difficult to hold the back brush firmly, thereby rendering it unfit for practical use. As such, it may be appreciated that there continues to be a need for a new and improved backbrush assembly as set forth by the instant invention which addresses both the problems of ease of use as well as effectiveness in construction and in this respect, the present invention substantially fulfills this need.

SUMMARY OF THE INVENTION

This invention is related for a multi-function back brush.

It is the primary object of the present invention to provide a multi-functional back brush of which the brush head can be conveniently adjusted in angular position.

It is another object of the present invention to provide a multi-functional back brush which can be rapidly engaged with various kinds of brush heads as desired.

It is still another object of the present invention to provide a multi-functional back brush which is easy to operate It is still another object of the present invention to provide a multi-functional back brush which is simple in construction.

It is a further object of the present invention to provide a multi-functional back brush which is fit for practical use.

The foregoing objects and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figures 1, 1A, 1B:
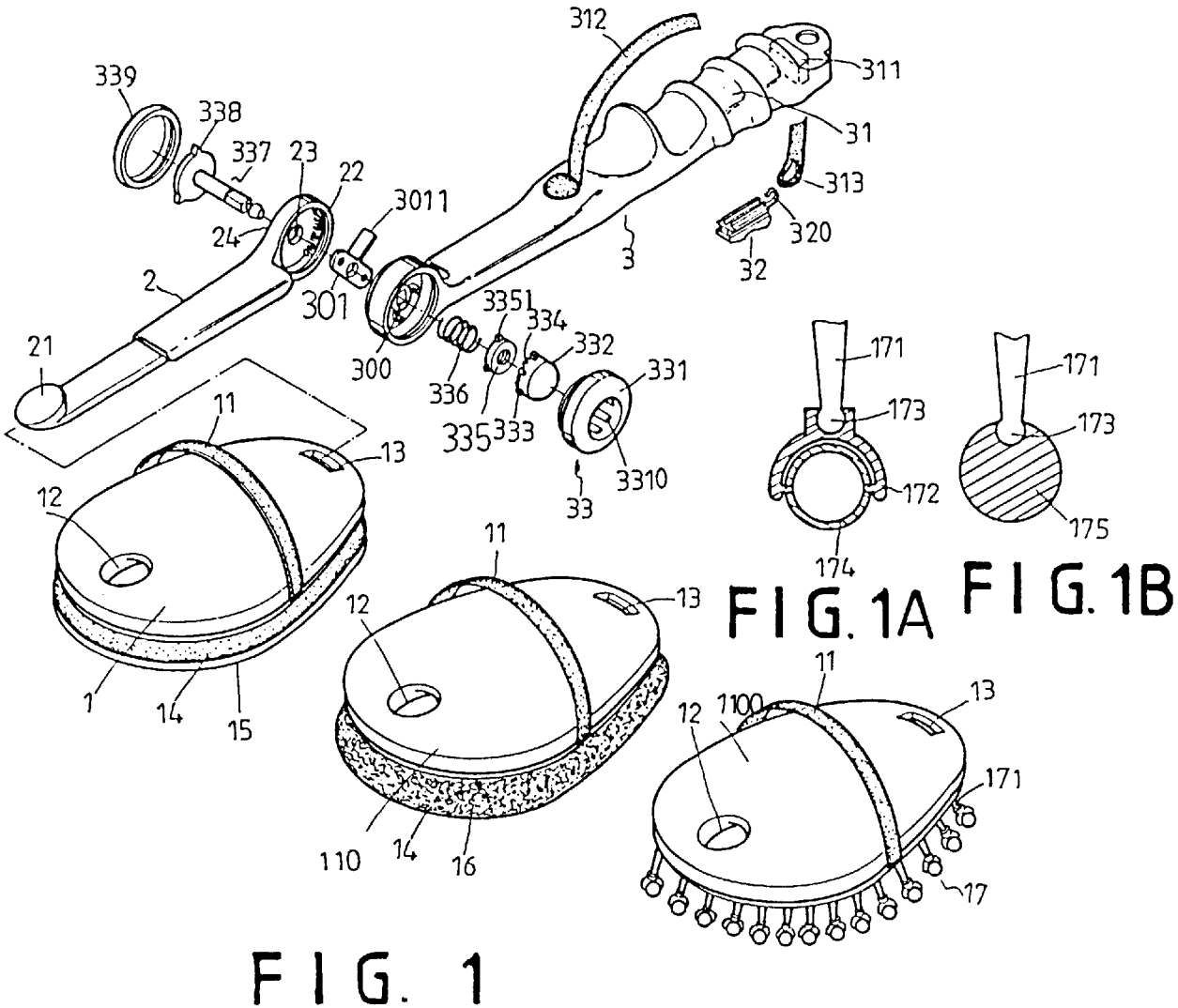
FIG. 1 is an exploded view of a back brush according to the present invention.
FIG. 1A is a fragmentary sectional view of the leg of the brush head.
FIG. 1B illustrates a second preferred embodiment of the leg.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
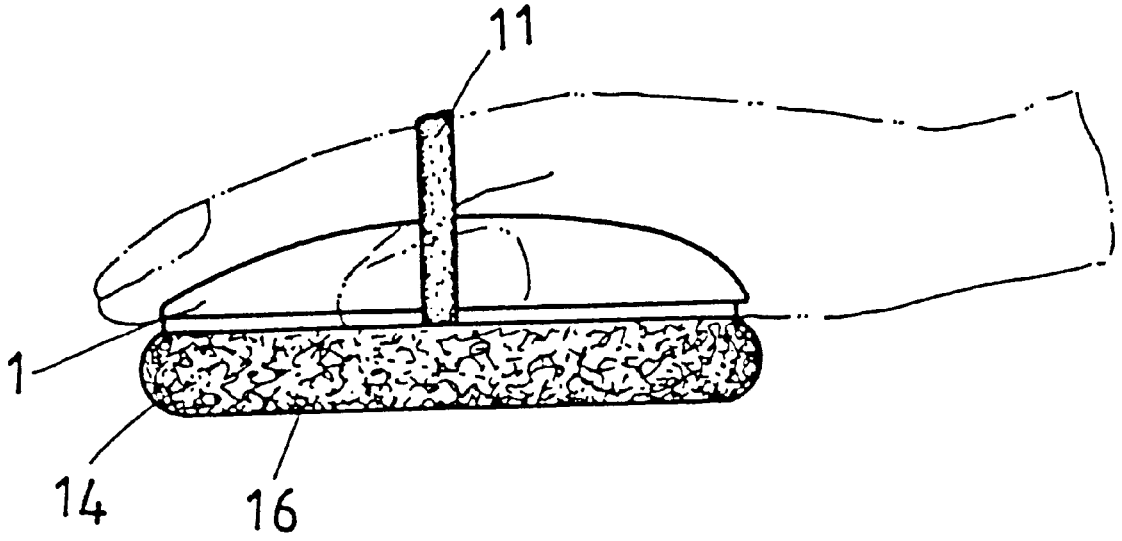
FIG. 2 illustrates how the brush head is used independently.
Figure 3:
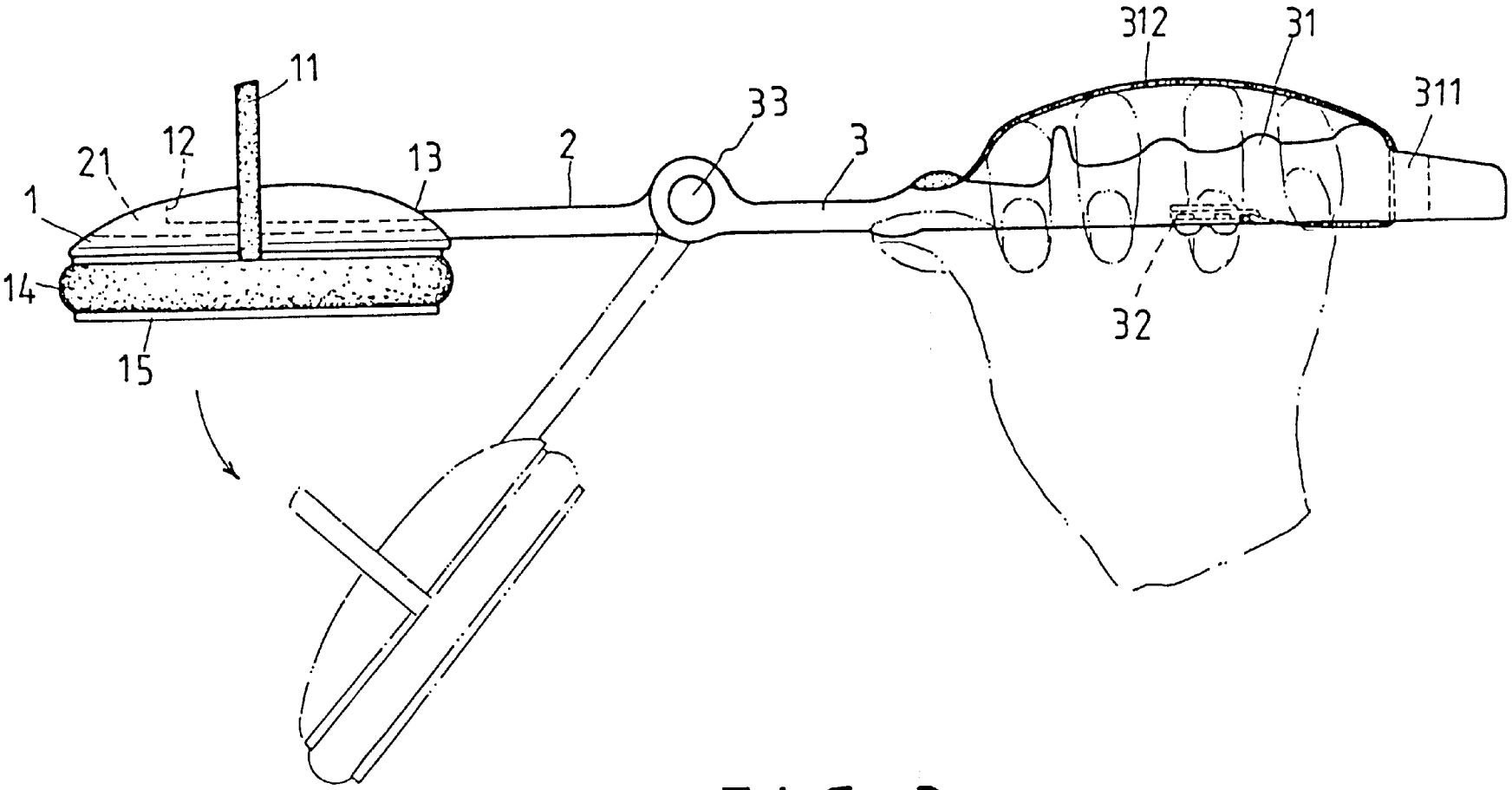
FIG. 3 illustrates the operation of the back brush.

With reference to the drawings and in particular to FIGS. 1 and 2 thereof, the multi-functional back brush according to the present invention basically comprises a plurality of brush heads 1, an adjustable shaft 2, a handle 3 and a pushbutton 33. The first brush head 1 includes a resilient sponge 14 under which there is a scour pad 15. The second brush head 110 is provided at the bottom with a resilient sponge 14 enclosed with a piece of towel cloth 16. The third brush head 1100 is provided with a plurality of depending legs 171 each of which is engaged with a rolling ball 17 for massage. As shown in FIG. 1A, the leg 171 has an enlarged spherical lower end 173 which is pivotally connected with a frame 172 in which is in turn pivotally connected a ball 17. The ball 17 may be directly pivotally connected with the enlarged spherical lower end 173 of the leg 171, as shown in FIG. 1B. Each of the brush heads 11, 110 and 1100 is provided with a strap 11 for holding with a hand (see FIG. 2) when the brush heads are used independently. Further, each of the brush heads 11, 110 and 1100 has a first opening 12 at the front end and a second opening 13 at the rear end adapted to engage with the adjustable shaft 2 thereby enabling the present invention to wash and massage the back easily and conveniently and therefore promoting the blood circulation and giving fun in taking a bath.

Figure 4:
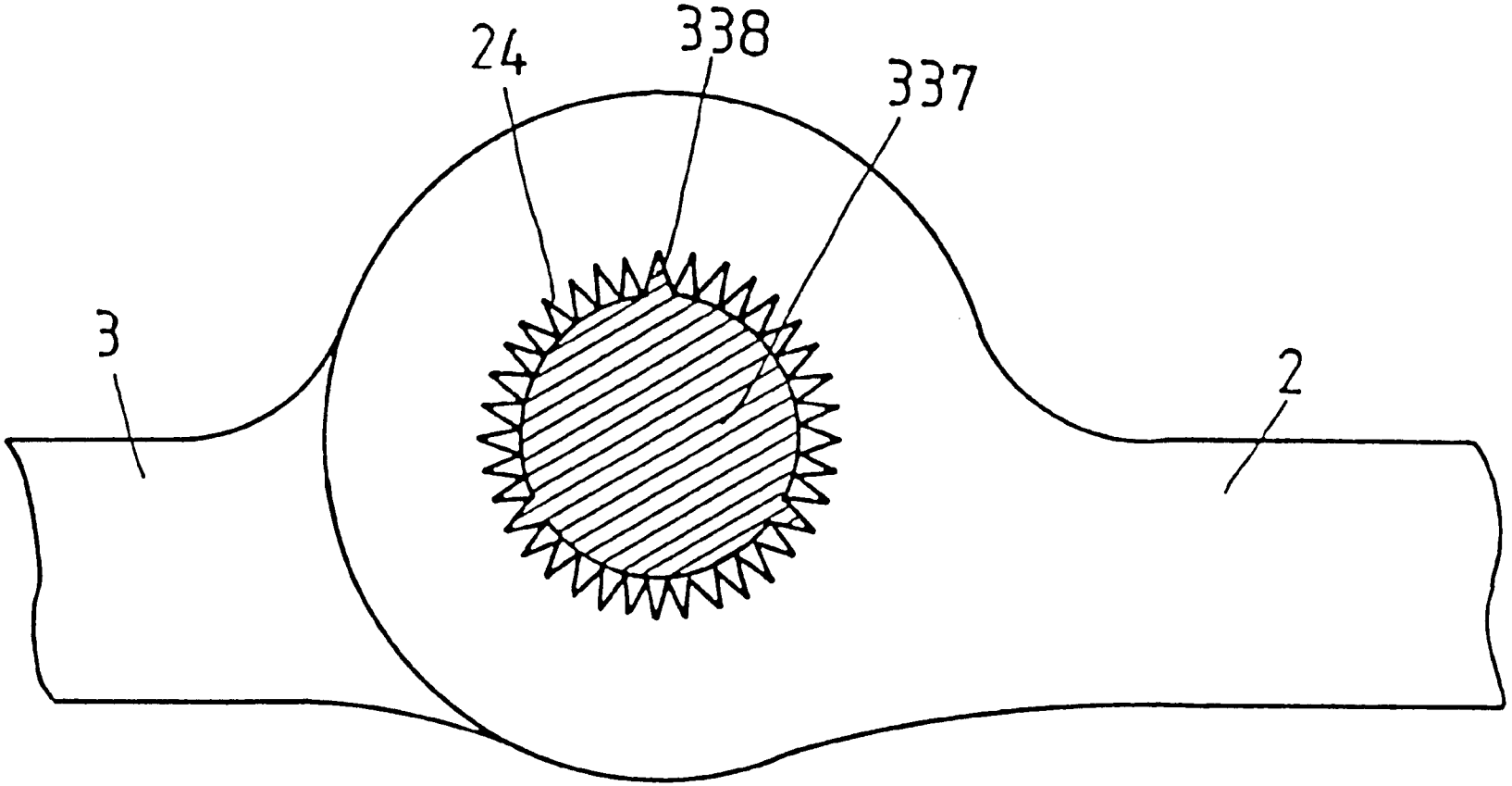
FIG. 4 illustrates the engagement between the disk of the axle and the adjustable shaft.
Figure 5:
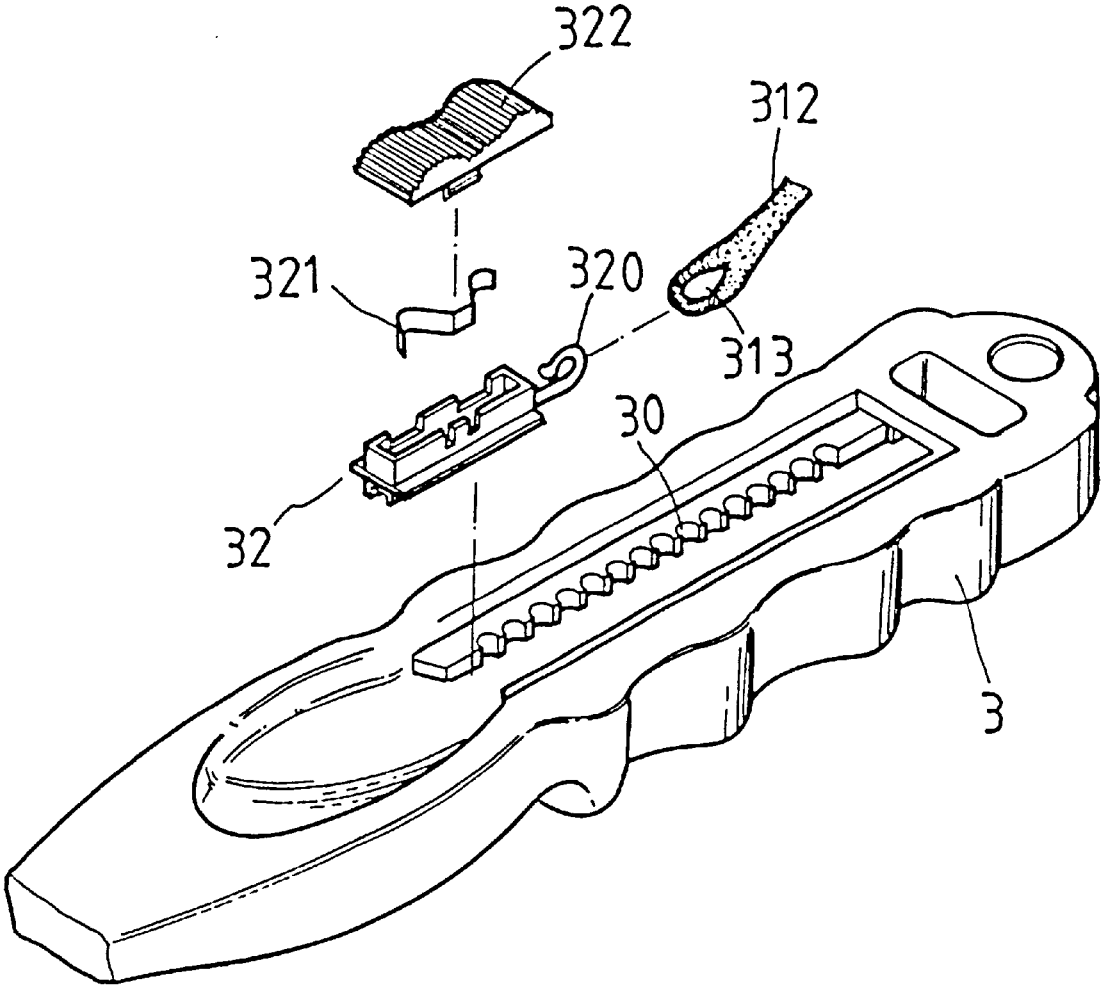
FIG. 5 is an exploded view of the handle.
Figure 9:
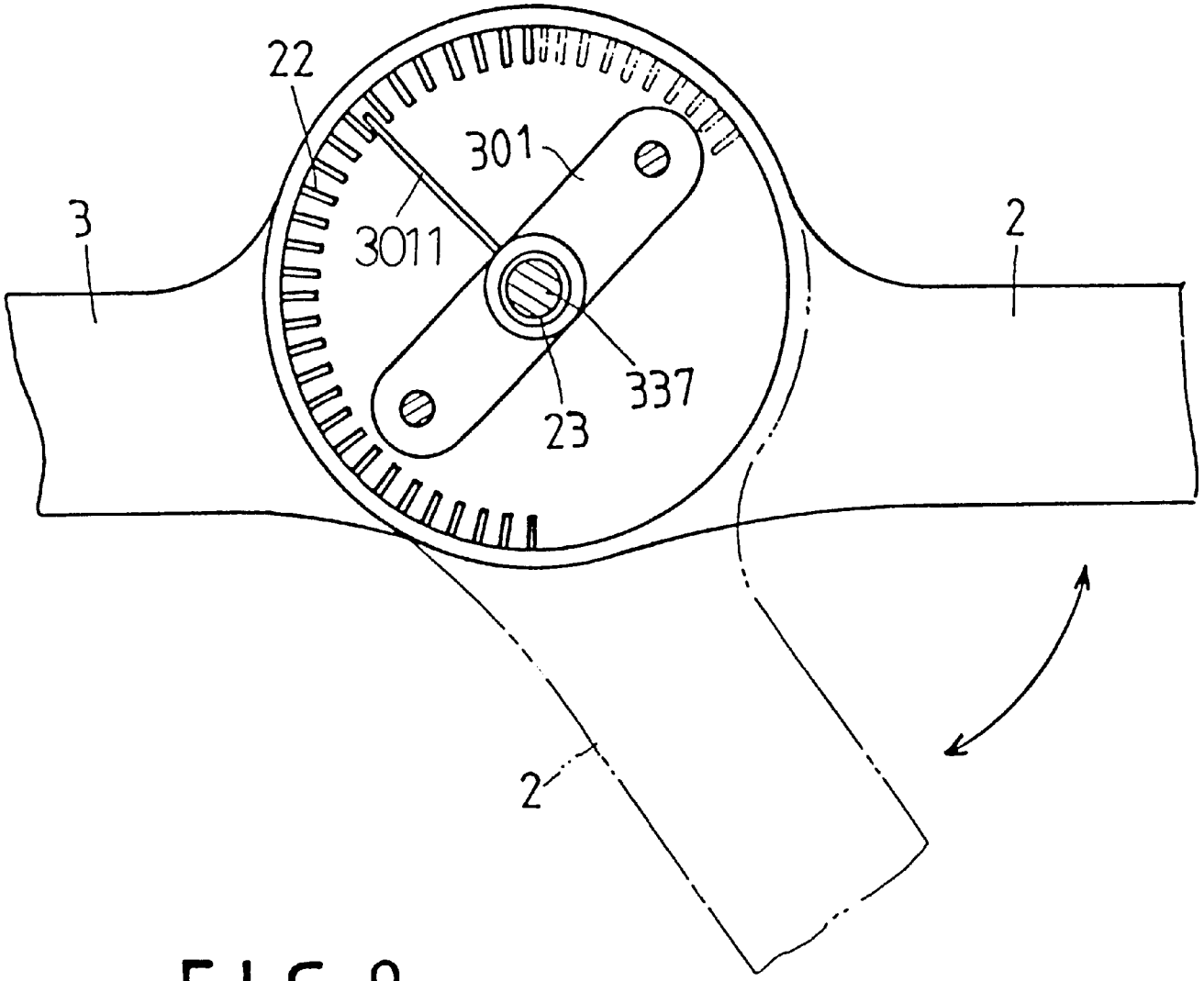
FIG. 9 illustrate how the T-shaped member is engaged with the adjustable shaft.

The adjustable shaft 2 is formed with an enlarged end 21 which is dimensioned to engage with the first or second opening 12 and 13 of the brush heads 11, 110 and 1100. The other end of the adjustable shaft 2 has a circular portion formed with a center through hole 23, a circular toothed recess 24 (see FIGS. 1 and 4) at one side and a plurality of radial partitions 22 (see FIGS. 1 and 9) at another side. An axle 337 is inserted through the center hole 23 of the circular portion of the adjustable shaft 2 and provided with a disk at one end. The disk has a plurality of teeth 338 adapted to engage with the circular toothed recess 24 of the adjustable shaft 2. A cover 339 is engaged with the circular portion of the adjustable shaft 2 for enclosing the disk of the adjustable shaft 2. A T-shaped member 301 is fixedly mounted on a circular end of the handle 3 and has a resilient blade 3011 adapted to engage with the radial partitions 22 of the adjustable shaft 2. The circular end of the adjustable shaft 2 has a square opening 300 at the center for receiving the square portion of the axle 337 so that the adjustable shaft 2 may be rotated with the handle 3. The pushbutton 33 is mounted on the other side of the circular end of the handle 3 and generally includes a cap 331 having a center hole and a plurality of longitudinal serrated grooves 3310 and threadedly engaged with the circular end of the handle 3, a push member 333 arranged within the cap 331 and having a plurality of teeth 334 and radial projections 333, an actuator 335 engaged with the push member 333, and a spring 336 fitted over the axle 337 (see FIGS. 6A and 6B). The handle 3 is provided with an elastic band 312 which has one end fixedly mounted on the intermediate portion of the handle 3 and another end extending through an opening 311 of the handle 3 and provided with a hole 313. The hole 313 of the elastic band 312 is engaged with a hook 320 of an adjusting block 32. The adjusting block 32 is provided with a leaf spring 321 engaged with a toothed rack 30 secured to the bottom of the handle 3 (see FIG. 5). A button 322 is engaged with the adjusting block 32 so that the button 322 may be regulated in position to adjust the elastic band 312 to fit for hands with different sizes.

Figure 6B:
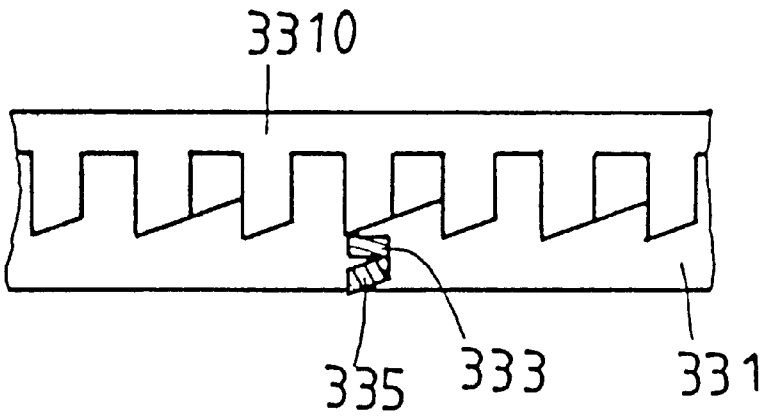
FIGS. 6A and 6B illustrates the relationship between the serration, the projection of the pushbutton, and the protuberance of the actuator when the pushbutton is depressed.
Figure 6A:
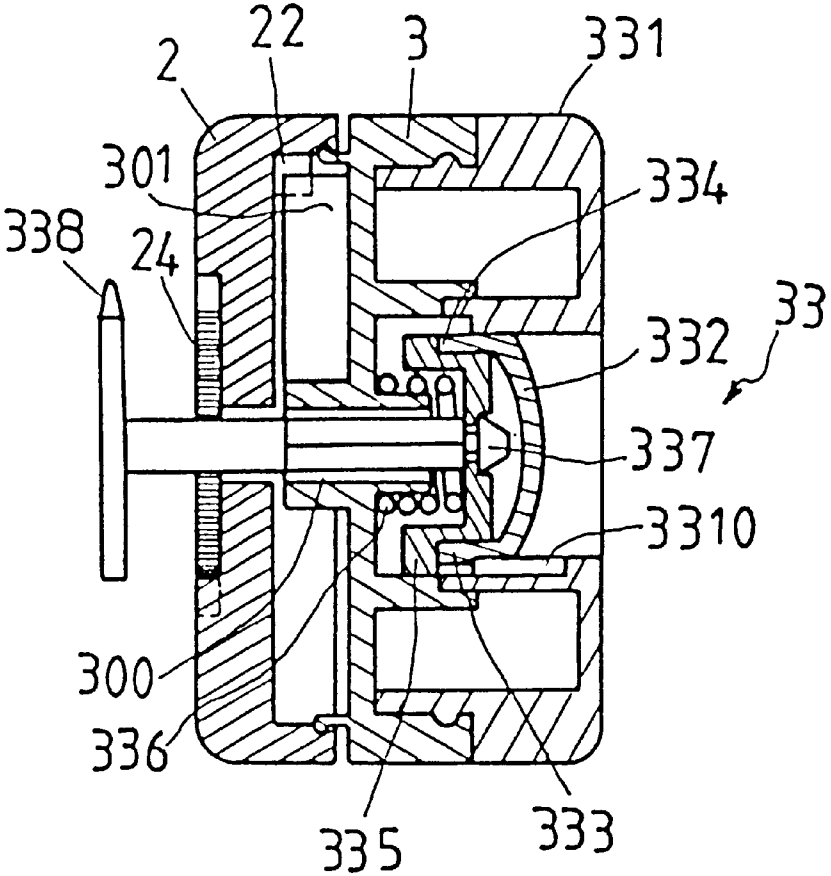

When desired to adjust the angular position of the brush head 1, it is only necessary to depress the push member 332 so that the protuberances 335, the spring 336 and the axle 337 will be moved to the left (with respect to FIG. 6A) thereby disengaging the teeth 338 of the axle 337 from the circular toothed recess 24 of the adjustable shaft 2. The relationship between the serrated groove 3310 of the cap 331, the projection 333 of the push member 332, and the protuberance 3351 of the actuator 335 is shown in FIG. 6B.

Figure 7B:
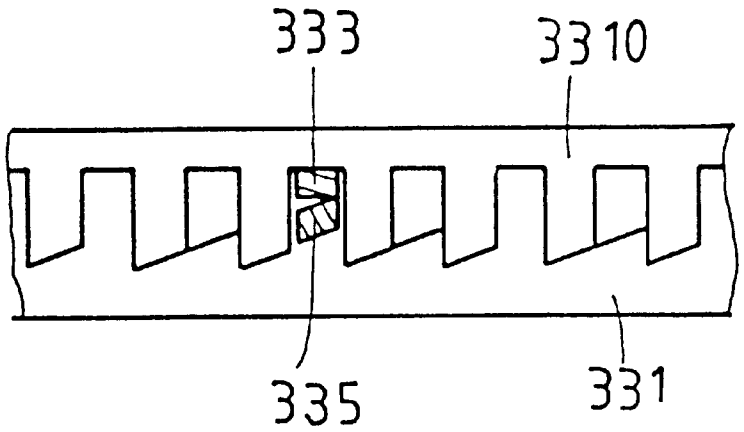
FIGS. 7A and 7B illustrates the relationship between the serration, the projection of the pushbutton, and the protuberance of the actuator when the pushbutton is released.
Figure 7A:
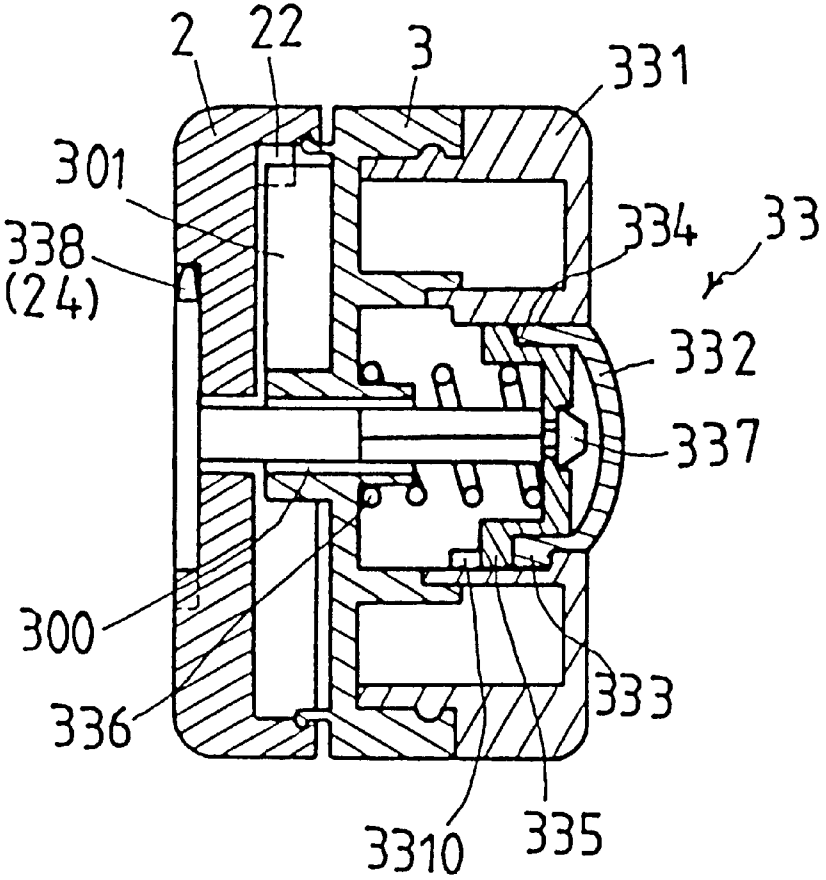

As the push member 332 is released, the spring 336 will push the actuator 335 and the push member 332 to the right (see FIG. 7A) thereby engaging the teeth 338 of the axle 337 with the circular toothed recess 24 of the adjustable shaft 2 and therefore preventing the adjustable shaft 2 from rotating with respect to the handle 3. The relationship between the serrated groove 3310 of the cap 331, the projection 333 of the push member 332, and the protuberance 3351 of the actuator 335 is shown in FIG. 7B.

Figure 8B:
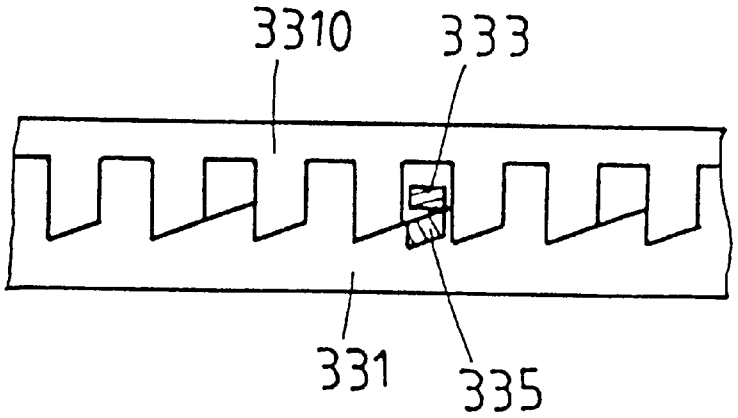
FIGS. 8A and 8B illustrates the relationship between the serration, the projection of the pushbutton, and the protuberance of the actuator when the pushbutton is depressed again.
Figure 8A:
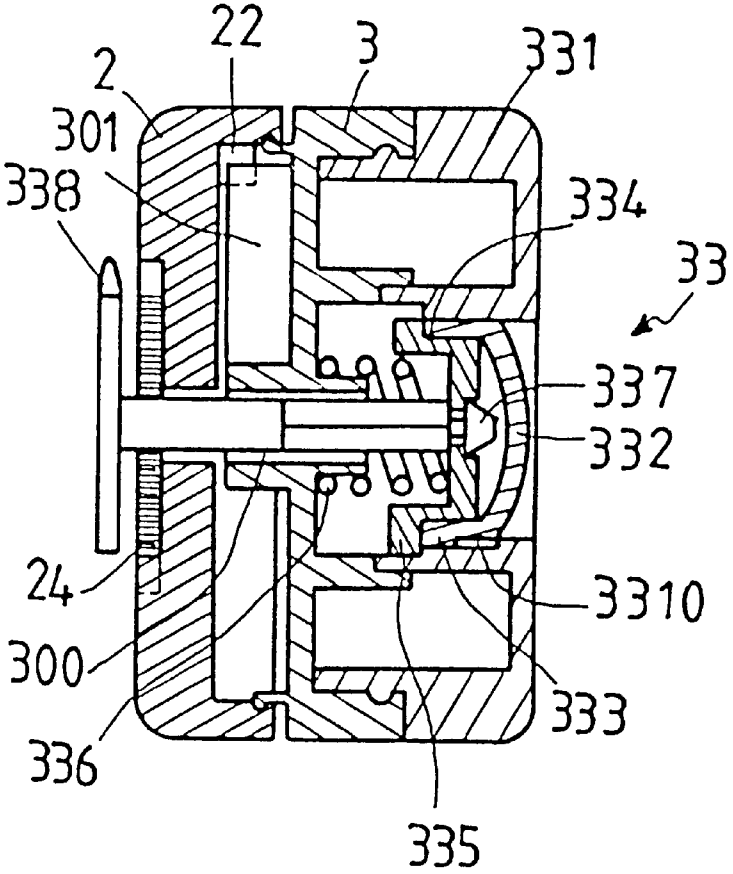

When the push member 332 is depressed again, the teeth 338 of the axle 337 will be disengaged from the circular toothed recess 24 of the adjustable shaft 2 thereby enabling the adjustable shaft 2 to be rotated with resepct to the handle 3 (see FIG. 8A). The relationship between the serrated groove 3310 of the cap 331, the projection 333 of the push member 332, and the protuberance 3351 of the actuator 335 is shown in FIG. 8B. As the adjustable shaft 2 is rotated, the resilient blade 3011 of the T-shaped member 301 will pass over the radial partitions 22 of the adjustable shaft 2 hence making clicking sound.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

I claim:

1. A multi-functional back brush comprising:

a brush head having an upper portion provided with a strap, a front end formed with a first opening, a rear end formed with a second opening;

an adjustable shaft having a first end engageable with said first and second openings of said brush head, said adjustable shaft having a second end which is circular in shape and provided with a center through hole, a circular toothed recess at one side thereof, and a plurality of radial partitions at another side thereof;

an axle fitted through said center through hole of said adjustable shaft and having an end provided with a disk formed with a plurality of teeth engaged with said circular toothed recess;

a cover engaged with said second end of said adjustable shaft;

a handle having a circular end engaged with said second end of said adjustable shaft, said handle being provided with an elastic band having one end secured to an intermediate portion of said handle and another end extending through an opening close to another end of said handle, said elastic band having an opening at an end thereof;

a toothed rack mounted on a bottom of said handle;

an adjusting block movably engaged with said toothed rack and having a hook engaged with said hole of said elastic band;

a T-shaped member fixedly mounted on said circular end of said handle and having a resilient blade engaged with said radial partitions of said adjustable shaft;

a spring fitted within said circular end of said handle;

an actuator arranged within said circular end of said handle and having one side bearing against said spring and provided with a plurality of radial protuberances;

a cap threadedly engaged with said circular end of said handle and having a center opening and a plurality of longitudinal toothed grooves; and a pushbutton fitted within said cap and having one side bearing against another side of said actuator and provided with a plurality of teeth and radial projections.

2. The multi-functional back brush as claimed in claim 1, wherein said brush head has a sponge under which is mounted a scour pad.

3. The multi-functional back brush as claimed in claim 1, wherein said brush head has a sponge enclosed with a piece of towel cloth.

4. The multi-functional back brush as claimed in claim 1, wherein said brush head has a bottom provided with a plurality of balls.

* * * * *